US005747919A

United States Patent [19]

Gandhi et al.

[11] Patent Number: 5,747,919

[45] Date of Patent: May 5, 1998

[54] ELECTRIC LAMP HAVING A HYBRID SKIRTED LAMP BASE

[75] Inventors: Harish F. Gandhi, Morgantown; Walter A. Boyce, Fairmont; David R. Woodward, Morgantown, all of W. Va.

[73] Assignee: Philips Electronics North America Corporation, NY, N.Y.

[21] Appl. No.: 671,890

[22] Filed: Jun. 28, 1996

Related U.S. Application Data

[63] Continuation-in-part of Ser. No. 366,135, Dec. 29, 1994, Pat. No. 5,568,009.

[51] Int. Cl.[6] ..... H01J 5/60

[52] U.S. Cl. ..... 313/318.01; 313/318.04; 313/318.09; 313/318.11

[58] Field of Search ..... 313/318.01, 318.04, 313/318.09, 318.11, 113, 25

[56] References Cited

U.S. PATENT DOCUMENTS

| | | | |
|---|---|---|---|
| 2,262,629 | 11/1941 | Wright | 176/32 |
| 2,268,700 | 1/1942 | Criger et al. | 176/32 |
| 2,336,529 | 12/1943 | Cartun | 176/32 |
| 2,429,287 | 10/1947 | McGowan et al. | 29/25.13 |
| 2,664,551 | 12/1953 | Kuebler | 339/146 |
| 2,732,532 | 1/1956 | Tamis | 339/146 |
| 2,736,873 | 2/1956 | Bechard et al. . | |
| 3,619,876 | 11/1971 | Besacier . | |
| 3,629,640 | 12/1971 | Audesse et al. | 313/318 |
| 3,775,634 | 11/1973 | Hasell et al. | 313/318 |
| 4,044,277 | 8/1977 | Komyati | 313/318 |
| 4,654,557 | 3/1987 | Haraden | 313/318 |
| 4,658,178 | 4/1987 | Bradley et al. | 313/113 |
| 5,126,634 | 6/1992 | Johnson | 315/71 |
| 5,313,134 | 5/1994 | Borgis et al. | 313/318 |
| 5,465,025 | 11/1995 | Hendrickson | 313/318.01 |
| 5,545,950 | 8/1996 | Cho | 313/318.01 |
| 5,568,009 | 10/1996 | Gandhi | 313/318.01 |

FOREIGN PATENT DOCUMENTS

| | | |
|---|---|---|
| 466897 | 9/1928 | Germany . |
| 54-19348 | 8/1980 | Japan . |
| 58-53655 | 4/1983 | Japan . |
| 444958 | 3/1936 | United Kingdom . |

*Primary Examiner*—Nimeshkumar Patel
*Attorney, Agent, or Firm*—Brian J. Wieghaus

[57] ABSTRACT

An electric lamp includes a hybrid skirted lamp base including a plastic skirt portion and a metallic skirt portion having one end portion molded in said plastic skirt portion and a second end portion secured to the lamp envelope. The metallic skirt portion improves structural integrity and provides some thermal isolation from the lamp envelope allowing the use of a lower temperature plastic for the plastic skirt portion. The plastic skirt portion includes a weldless and solderless lamp base. A lamp cap contact includes a rigid shank received in a clamping bore of the plastic skirt portion. The diameters of the bore and shank and the elasticity of the bore wall are selected so that a conductive lead of the lamp is securely clamped between the shank and the bore wall when the shank is fully received in the bore. In a favorable embodiment, the lead has a free end extending in the direction of insertion of the shank into the bore, which avoids the lead wire from being pushed out of the bore.

31 Claims, 3 Drawing Sheets

ELECTRIC LAMP HAVING A HYBRID SKIRTED LAMP BASE

CROSS REFERENCE TO RELATED APPLICATIONS

This is a continuation-in-part of U.S. application Ser. No. 08/366,135 filed Dec. 29, 1994, now U.S. Pat. No. 5,568,009, of Harish Gandhi entitled "Electric Lamp have a Lamp Cap with Solder Free Connections".

BACKGROUND OF THE INVENTION

The invention relates to an electric lamp comprising:

a lamp envelope including a pressed glass reflector body, a light source within the lamp envelope which is energizeable for emitting light, a lamp base having lamp contacts electrically connected to said light source, one of said lamp contacts comprising a threaded shell, and a skirt mechanically secured to said reflector body and carrying said lamp base.

Such a lamp is known from U.S. Pat. No. 4,658,178 in the form of a PAR lamp. The skirt is made of plastic and has a first end with ramp-like extensions engaged in dimples in thereflector body to mechanically secure the skirt to the envelope. The skirt has a second end carrying a screw-type lamp base in the form of an outer threaded shell secured on a shank portion of the plastic skirt and a center contact. The lead wires from the light source are welded to each of the contacts. Various plastics for the skirt are disclosed for accommodating different temperatures of the lamp envelope.

SUMMARY OF THE INVENTION

It is an object of the invention to provide an electric lamp with an improved skirted lamp base construction, and which is solder-free and weld-free.

According to the invention, a lamp of the type described in the opening paragraph is characterized in that:

the skirt includes a metallic skirt portion secured to the lamp envelope and a plastic skirt portion mechanically secured to the metallic skirt portion and carrying the threaded shell.

Applicants discovered that with an all plastic skirt, the relatively high temperature of the rear of the PAR lamp envelope, in lamp wattages as low as about 100 W, changed the characteristic of certain plastics over time. For example, it was found that with an all plastic skirt of ULTEM 1000™ available from the General Electric Company, cracking and clarification of the plastic occurred with an envelope temperature at the skirt/envelope interface of about 210°–300° C., reducing the integrity of the skirt.

The lamp designer in this instance could try to select another plastic with higher temperature resistance. However, such materials may have other less desirable characteristics such as higher initial cost, constraints on the molding process, brittleness, lower elasticity, etc. Plastic skirts are typically secured to the lamp envelope by mechanical means, such as with tabs or nubs engaging in respective dimples at the basal end of the lamp envelope, so as to avoid the use of cement and the consequent curing times. High temperature plastics generally have a higher glass fiber content, making them less elastic and generally more brittle. Furthermore, pressed glass reflector bodies generally have large dimensional variations over the course of a production run due to mold wear, for example, on the order of 0.5 mm for a PAR 38 lamp. With skirts of high temperature plastic, these tolerances make it difficult to obtain a proper fit with the lamp envelope because they are not sufficiently elastic to expand and snap onto the lamp envelope if undersized, leading to an unacceptable scrap rate in production. The more brittle nature of higher temperature plastics also leads to cracking due to differences in coefficients of thermal expansion between the plastic and reflector body during lamp use.

The metallic skirt portion according to the invention is sufficiently ductile to allow simple assembly to the lamp envelope by known techniques, such as peening. Additionally, the metal skirt portion was found to provide an advantageous temperature drop across its length, reducing the temperature seen by the plastic portion on the order of 5–7.5%. This was a surprise, because a metals generally have a high thermal conductivity and would not be expected to significantly reduce the temperature seen by the plastic portion. This temperature drop allows for the use of a lower temperature plastic, which is generally of lower cost and which generally provides more desirable mechanical characteristics for attaching components of the lamp base, such as greater elasticity, than a higher temperature plastic.

According to a favorable embodiment, the metallic skirt portion includes parts integrally molded in the plastic skirt portion. This provides a low-cost method of securing the two skirt portions together, which is automatically obtained during the molding process of the plastic portion of the skirt.

Favorably, the part of the metallic skirt portion which is molded in the plastic skirt portion includes a circumferential flanged rim. The flanged rim provides structural stiffness to the sleeve at the area of the joint while also providing additional surface area for contact with the plastic, thereby improving the overall integrity of the hybrid skirt.

It should be noted that U.S. Pat. No. 2,262,629 shows a PAR lamp with a metal skirt carrying a base have a threaded shell over an insulator body. The insulator body, as used in the industry for close to 50 years, is not plastic but glass. Such an insulator is not useful as a skirt.

According to another embodiment of the invention, the lamp base includes a lamp base contact electrically connected to a conductive lead from the light source. The lamp base contact has (i) a contact portion for contacting a corresponding contact in a socket and (ii) a rigid shank extending from the contact portion. The plastic skirt portion has a bore wall defining a clamping bore for receiving the shank, the bore being sized and the plastic portion surrounding the clamping bore having an elasticity selected such that (i) the electric lead is securely clamped between the shank and the bore wall when the shank is inserted into the clamping bore with the contact portion seated against the insulative portion and (ii) the lamp contact is secured in the clamping bore solely by friction between the shank and the bore wall, the shank and the bore wall being free of any snap-type engagements.

The above features provide a simple, readily manufacturable lamp base construction in which a simple insertion of the contact's shank into the clamping bore (i) firmly secures the lamp contact in the lamp cap and (ii) provides a reliable electrical connection of the lead to the contact and mechanical connection of the lead to the lamp cap The contact itself is simple—there are no bendable leaves, tabs, lips, flaps or fingers. Accordingly, no closing of these elements is required as with prior art lamp caps, known for example, from U.S. Pat. Nos. 2,664,551; 2,736,873 and 2,732,532. No additional welding, soldering, peening, pinning, swaging or other metal forming of this contact is required either. The simple shape of the contact and the simple axial insertion motion of the contact into the bore implies a rather simple mechanization, which is extremely important for the very high speed manufacturing necessary for a commercially successful lamp production. The hybrid-metal skirt allows the use of lower temperature plastics which have the required elasticity.

According to a favorable embodiment, the lead extends into the clamping bore with its free end extending in the direction of insertion of the shank into the clamping bore. This avoids the possibility of the lead being pushed out of the bore back towards the lamp envelope when the shank is inserted in the clamping bore. This also has the significant advantage that since the free end of the lead is extending into the bore in the direction of the envelope the lead does not extend to the exterior of the lamp cap. Thus, no trimming of the lead is necessary, further simplifying production.

The above-described orientation of the lead is carried out in one embodiment by a guide bore in the plastic skirt portion which axially extends adjacent the clamping bore. The lead extends from the lamp envelope through the guide bore in the direction opposite the direction of insertion of the shank arid then extends into the clamping bore, providing a simple threading path. Favorably, the guide bore includes tapered guide walls narrowing in the direction away from the lamp envelope for guiding the lead into and through the guide bore as the skirt is placed onto the lamp envelope to receive the lead. Thus, less criticality is required in aligning the skirt with the envelope to reliably thread the lead during high speed production.

To provide a neat, tamper-proof appearance it is desirable that the guide bore terminates adjacent the clamping bore so that the guide bore and the lead extending therefrom into the clamping bore are fully covered by the contact portion of the lamp cap contact. To further improve appearance and tamper resistance, in another embodiment the insulative portion includes a counter bore having a shape complimentary to the contact portion and into which the contact portion is recessed. Recessing the circumferential outer edge of the contact in this manner renders it very difficult for a user to remove the contact without tools.

Instead of the guide bore extending axially adjacent the clamping bore for guiding the lead to the exterior, the guide bore may communicate directly with the clamping bore and guide the lead directly into the clamping bore, for example, at right angles to its axis. This has the advantage that the clamping bore itself acts as a stop to limit the exposure of the lead, thereby automatically measuring the length of the lead to be clamped in the bore.

In yet another embodiment, suitable for lamps which use leads having a conductive core covered by an insulative sheath, the guide bore itself includes a stop which engages the sheath but not the core to control the length of the core inserted into the clamping bore. This feature also prevents the possibility of the lead from being pulled further into the bore during insertion of the shank.

The above-described guiding features are also applicable to the other lead clamped by the threaded shell.

These and other features of the invention will be described with reference to the following drawings and detailed description, which are illustrative of the inventive features and not limiting.

DESCRIPTION OF THE PREFERRED EMBODIMENTS

Figure 1:
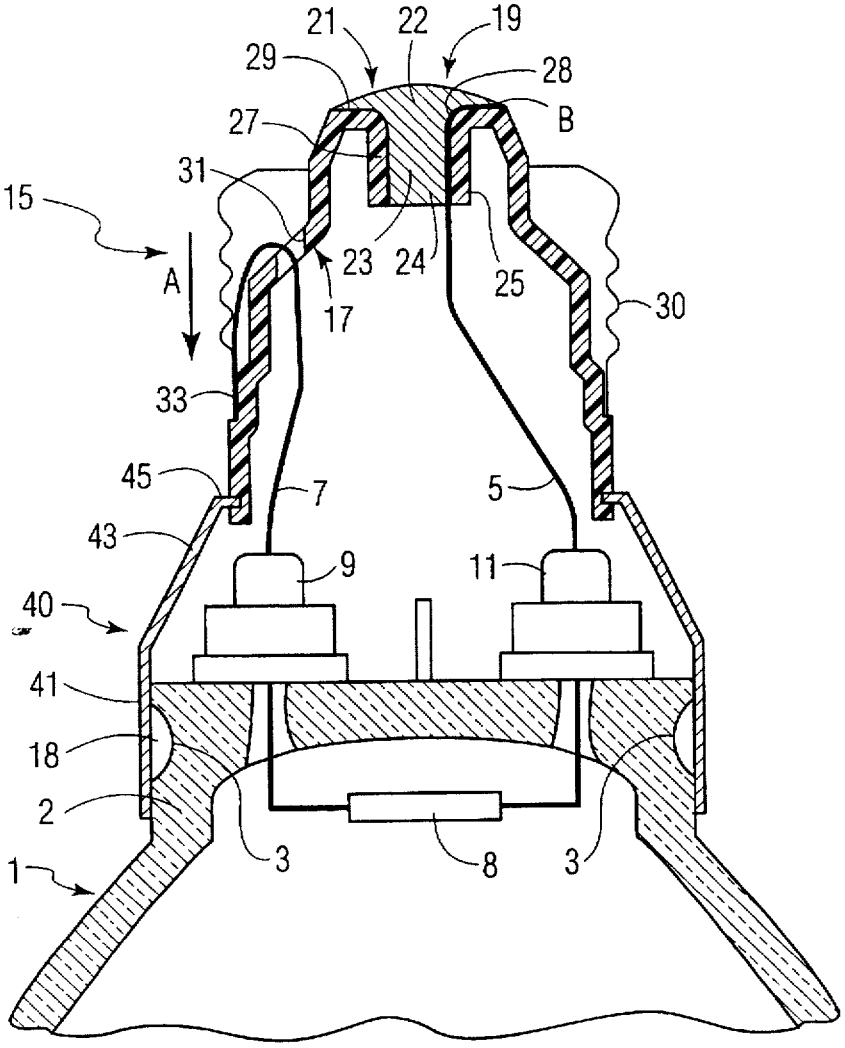
FIG. 1 is a diagrammatic cross-section of a PAR lamp illustrating a first embodiment of a hybrid skirted lamp base according to the invention.

FIG. 1 shows an end portion of the reflector body of a parabolic aluminized reflector (PAR) lamp including a lamp cap which embodies several features of the invention.

The lamp includes a lamp envelope 1 of pressed hard glass having a plurality of recesses 3. A conductive center lead wire 5 and a corresponding side wire 7 extend from respective ones of ferrules 9, 11 in the axial direction away from the lamp envelope 1. The ferrules 9, 11 hermetically seal the envelope 1 and provide mechanical support and electrical connection to the light source, in the form of an incandescent filament 8, in a well known manner. Alternatively, the light source could be a halogen burner or a high pressure gas discharge arc tube, such as a metal halide arc tube.

A skirted lamp cap 15 is secured to the envelope 1 and includes a skirt with a plastic portion 17 of synthetic resin material and a metallic portion 40. The plastic portion 17 carries a lamp base including a center contact 19 and a threaded shell 30. The contact 19 has (i) a contact portion 21 for contacting a corresponding contact in a mating socket and (ii) a rigid shank 23 extending from the contact portion 21. The plastic portion 17 has a re-entrant portion 25 with a bore wall 27 defining a clamping bore for receiving the shank 23. The bore wall 27 has a diameter selected relative to that of shank 23 and the synthetic resin material of the portion 17 has a modulus of elasticity selected so that the center lead 5 is securely clamped between the shank 23 and the bore wall 27 when the shank is inserted into the clamping bore with the underside 22 of the contact portion 21 seated against the end surface 23 of the reentrant portion 25. The lamp contact 19 and lead wire 5 are secured in the clamping bore solely by the press fit between the shank 23 and the bore wall 27 due to the elasticity of the synthetic resin material of the bore wall.

In the lamp cap of FIG. 1, the shank 23 and the bore wall 27 are both circular cylindrical in shape. The shank 23 has a rounded/chamfered edge 24 as does bore wall 27 (at reference numeral 28) to guide the shank during insertion into the clamping bore. Alternatively, the shank/bore may have a slight taper, for example on the order of 1°–2° towards the lamp envelope. The shank 23 as shown is solid, but may be tubular. The simplicity of these shapes allow these elements to be more cheaply manufactured than some of the more complicated components present in the prior art, such as with the spring-fingers of the contact shown in U.S. Pat. No. 2,336,529 or the quadrant flaps of U.S. Pat. No. 2,664,551. Additionally, the insertion of the contact into the clamping bore in the present invention completes the assembly, whereas the tubular rivet of the '529 patent and the flaps, tabs, lips or leaves of the '551 patent and other known patents require further mechanical deformation to clamp the wire after their contacts are first secured to their respective insulative bodies. Accordingly, it is readily seen that the disclosed arrangement according to the invention is a simple, elegant, yet effective solution which has previously remained unrecognized by those in the lamp arts.

The threaded metallic contact 30 is in electrical contact: with the side lead wire 7. The side lead wire extends from ferrule 9 through bore 31 and then back towards the envelope 1 in the direction of insertion (indicated by Arrow A) of the threaded contact 30. The threaded shell 30 is circumferentially swaged or peened to the plastic skirt portion 17 at the axial location indicated by reference numeral 33 to mechanically secure it thereto and to provide electrical contact with side wire 7. It is noted that it is known from commercially available compact fluorescent lamps to fix the side lead-wire between the threaded metallic shell of the lamp cap and the plastic housing by swaging, peening, or otherwise deforming the threaded shell onto the plastic housing with the side lead wire therebetween.

The metallic skirt portion 40 includes a first circumferential end portion 41 for receiving the basal portion 2 of the lamp envelope. A second circumferential end portion 43 is integrally molded in a first end portion of the metal skirt. The second end portion of the metal skirt includes a flanged rim 45 extending generally transverse to the lamp axis. The flanged rim extends about the entire circumference of the metal skirt portion. The flanged rim adds structural rigidity to the end of the skirt as well as providing additional surface area with which the plastic of skirt portion 17 bonds. The rim 45 also includes slots or holes distributed about its circumference through which the plastic material of skirt portion 17 extends. This ensures that the skirt portion 17 is rotationally locked to the skirt portion 40. The first end portion 41 of the metallic skirt portion is secured to the basal portion 2 by peening into recesses 3. No cement is used.

Various samples were made to test the feasibility of the hybrid lamp base according to the invention. In a first experiment, lamp bases with hybrid skirts according to FIG. 1 were compared to all-plastic skirts. In both cases, the plastic was ULTEM 1000™. For the lamp cap according to FIG. 1, the metallic skirt was made of brass having a wall thickness of 0.4 to 0.5 mm. Both samples were placed in an oven at 250° C., which is the maximum fixture temperature for a high-hat fixture according to the IEC standards. After 48 hours, the all-plastic skirted bases completely melted and ended up as a puddle of plastic while the hybrid skirted bases according to the invention remained intact and useable. This was completely surprising, since after 48 hours in the oven both the all-plastic and the hybrid skirted bases would be experiencing the same temperature regardless of the difference in the heat capacity and conductance between the metallic skirt portion of the hybrid bases and the corresponding plastic portion of the all-plastic bases. It is believed that the presence of the metallic skirt portion added structural integrity and prevented the plastic from deforming and flowing.

In additional tests, six bases were made and again placed in an oven at 250° C for 90 hours. The six bases included three hybrid and three all-plastic bases with each of the plastics of Table I.

TABLE I

| Brand/ Designation | Source | Type | Deflection Temp. (C.) @264PSI | Flexural Modulus (GPA) |
|---|---|---|---|---|
| Ryton/RT02 | Philips 66 | Poly-phenylene Sulfide | >260 | 1.72 |
| Amodel ® AF-4133X | Amoco Polymers | Polyphath-almide (33% Glass Reinforced) | 294 | 12.4 |
| Wellamid ™ | Wellman, Inc. | Nylon 66 | 240 | 6.85 |

As illustrated in Table II, after 90 hours each of the all-plastic skirts exhibited significant visible damage including marks and shape distortions. In contrast, the hybrid skirts of Ryton and Amodel showed no visible damage. The hybrid base of Wellamid showed minor distortion on the interior of the shell.

TABLE II

| SHELL | | CRACKS | DISTORTION |
|---|---|---|---|
| AP | Wellamid | Y (melted) | Major |
| AP | Amodel | Y | Major |
| AP | Ryton | Y | Major |
| H | Wellamid | N | Minor Interior |
| H | Amodel | N | No |
| H | Ryton | N | No |

H= Hybrid;
AP= All Plastic.

In yet another test, two complete 120 W, 120 V PAR lamps were burned base-up in high-hat fixtures at 100%, 110%, and 120% of rated voltage and stabilized for 2 hours at each voltage. One lamp had an all-plastic base of Wellamid Nylon 66 and one lamp had a hybrid base in which the plastic portion was of Amodel plastic. Temperature measurements were taken at the interface of the shell with the reflector heel ("Temp 1"), and the joint between the skirt and the plastic (for the hybrid base) and the corresponding location for the all-plastic base ("Temp 2"). These temperatures are shown in Table III.

TABLE III

| | Hybrid | | | All-Plastic | | |
|---|---|---|---|---|---|---|
| | 120V (100%) | 132V (110%) | 144V (120%) | 120V (100%) | 132V (110%) | 144V (120%) |
| TEMP 1 | 164° C. | 175 | 187 | 133 | 142 | 151 |
| TEMP 2 | 177 | 189 | 202 | 179 | 188 | 202 |

As shown in Table III, with the all-plastic skirts, the highest temperature experienced was 202° C., at the interface of the plastic with the glass reflector body. For the hybrid skirt, the highest temperature was the same, at the interface with the reflector body, but this temperature is seen by the metal skirt portion. The highest temperature seen by the plastic was 187° C., about 7.5% less than with the all-plastic skirt. At rated voltage, the highest temperature of the plastic was still about 5% lower than for the all-plastic skirt. It should be noted that the difference in plastic between the two samples is not believed to effect the temperature measurements.

Figure 2:
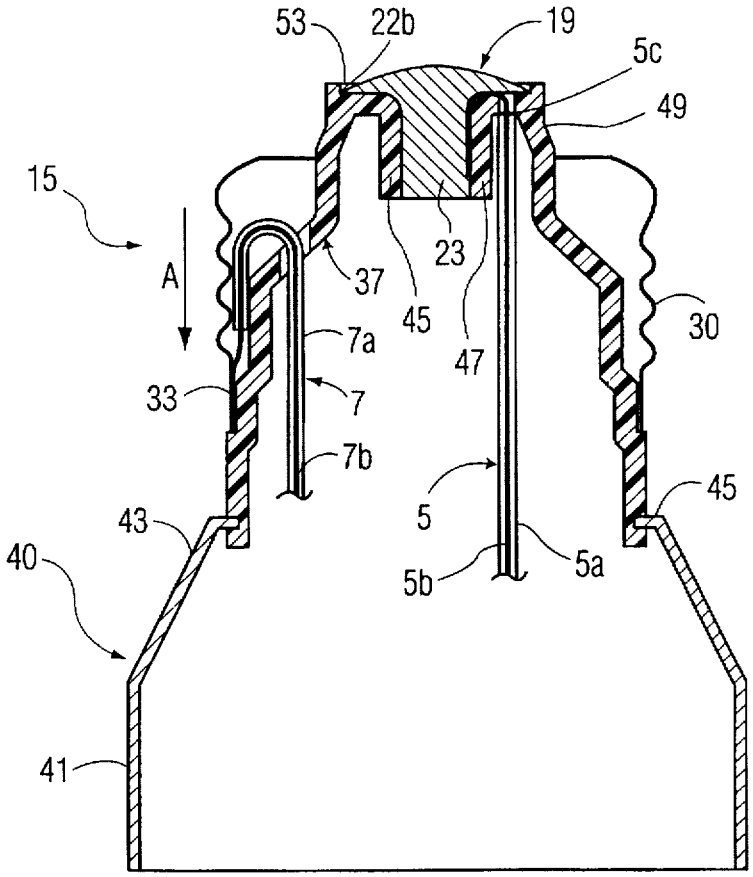
FIG. 2 is a diagrammatic cross-section of the plastic portion of the skirt illustrating a second embodiment with a variation of the threading path of the center lead wire from that shown in FIG. 1.

FIG. 2 illustrates a variation of the plastic portion for use with lamps having insulated conductive leads. Parts identical to those in FIG. 1 bear the same reference numerals. The threaded metal shell 30 and the side lead wire 7 are connected to the plastic skirt portion 37 in the same manner as skirt portion 17 in FIG. 1. The leads 5, 7 in this embodiment have an insulative sheath 5*a*, 7*a* about their conductive single-strand core 5*b*, 7*b* respectively. The skirt portion 37 has tapered guide walls 49 for guiding the lead 5*a* through the guide bore 50. The guide walls 49 also serve as a stop for limiting the length of the trimmed end portion 5*c* (stripped of its insulative sheath) which extends out of the guide bore 50 by engaging the end of the insulative sheath. The trimmed end portion 5*c* is clamped between shank 23 and the bore wall 47 of the re-entrant portion 45 in the same manner as in FIG. 1. However, since the free end portion 5*c* extends in the same direction as the direction of insertion of the shank into the clamping bore, (indicated by arrow "a"), the free end. portion cannot be pushed out of the bore during insertion of the shank 23. Movement of the lead wire 5 is further limited by the interaction of the end of the sheath 5*a* with the tapered guide walls.

The skirt portion 37 also has a recess 53 which has a complementary shape to the outer circumferential edge 22*b* of contact 19. Recessing of this edge prevents tampering by the user to remove contact 19. The guide bore 50 and lead 5 are also covered by the contact portion 21 of contact 19, providing a neat, clean appearance. Since end portion 5*c* extends into the guide bore in the direction of insertion of shank 23, it need not be trimmed as is the case with the excess shown in FIG. 1 with dashed lines.

Figure 3:
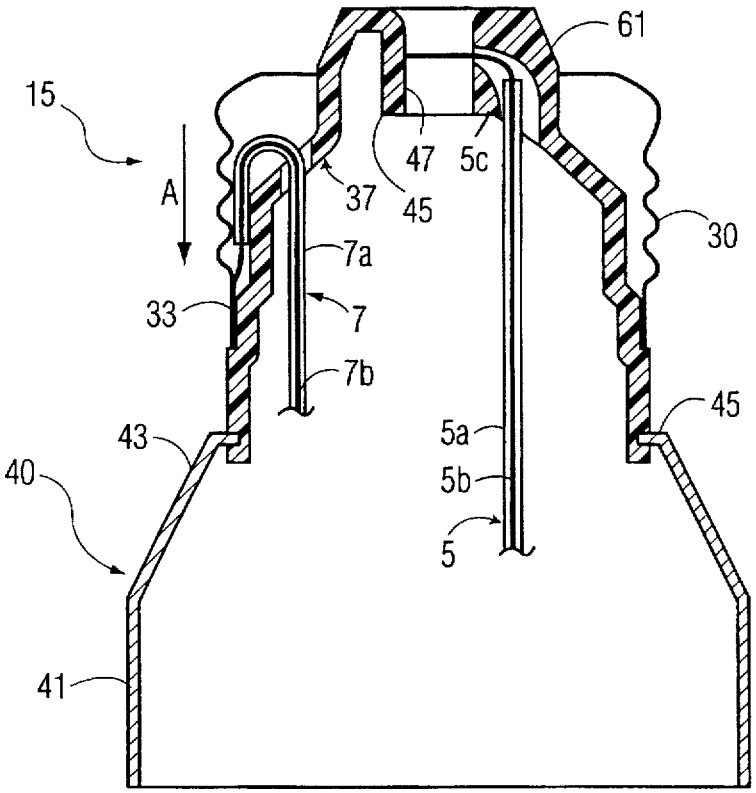
FIG. 3 is a diagrammatic cross section of a third embodiment illustrating another threading path for the center lead-wire.

FIG. 3 shows a construction similar to that in FIG. 2 but in which the guide bore 61 communicates directly with the clamping bore, extending generally transversely to the direction of insertion (identified by arrow "a") of shank 23. The length of the free end portion 5*c* is limited by the opposing face of the bore wall 47, opposite that through which the guide bore extends. The contact 19 is not shown, to better illustrate the position of end portion 5*c* after threading through the guide bore 61. Upon insertion of shank 23 into the clamping bore, the end portion 5*c* will deflect downward and be clamped between bore wall 47 and shank 23. Since the guide bore 61 enters directly into the clamping bore, the lead 5*c* never extends to the outside and does not need to be trimmed.

In the embodiments shown above, suitable materials for the center contact 19, the threaded shell 30 and the skirt portion 40 include brass and aluminum. It should be noted that in prior art bases which used a glass insulator, aluminum could not be used for the threaded shell because the molten glass destroyed the aluminum. Thus, the much lower temperature setting plastics in the skirt portion expands the choice of metals available to the lamp designer. The lead wires for the embodiment of FIG. 1 (PAR lamp) were of 0.030"/0.025" nickel solid wire. The lead wires for the embodiments of FIGS. 2,3 had one (1) tinned copper strand with a PVC/nylon insulation sheath.

Those of ordinary skill in the art will appreciate that at different wattages and with different light sources the temperature at the heel of the reflector will be different than that illustrated in Table III, and may require a different choice of plastic material. However, the use of a hybrid skirt according to the invention will provide greater structural integrity while allowing the selection of a lower temperature plastic than would be possible with an all-plastic base.

The above-described embodiments illustrate various features; each of which may be used with various combinations of the others and for different lamp types and lamp cap configurations other than that shown. Those of ordinary skill in the art will appreciate that various modifications can be made which are still within the scope of the appended claims. Accordingly, the above embodiments should be considered to be illustrative only, and not limiting.

We claim:

1. An electric lamp comprising a lamp envelope including a pressed glass reflector body defining a lamp axis, a light source within said lamp envelope which is energizable for emitting light, a lamp base having lamp contacts electrically connected to said light source, one of said lamp contacts comprising a threaded shell and a skirt secured to said reflector body and carrying said lamp base, characterized in that:

said skirt includes a metallic skirt portion mechanically secured to said reflector body and a plastic skirt portion fixed to said metallic skirt portion, said plastic portion including a first part carrying said threaded shell and a second part extending axially past said threaded shell toward said reflector body, said metallic skirt portion including parts integrally molded in said plastic skirt portion and extending transverse to said lamp axis.

2. An electric lamp according to claim 1, wherein said transversely extending part integrally molded in said plastic skirt portion is a circumferential flanged rim.

3. A lamp according to claim 2, wherein said flanged rim has a series of holes through which said plastic skirt portion extends.

4. An electric lamp according to claim 1, further including a conductive lead connected to said light source and wherein said lamp contacts further comprise a center contract including (i) a contact portion for contacting a corresponding contact in a socket and (ii) a rigid shank extending from said contact portion; and said plastic skirt portion has a bore wall defining a clamping bore for receiving said shank, said bore being sized and said plastic portion surrounding said clamping bore havinc an elasticity selected such that (i) said first conductive lead is securely clamped between said shank and said bore wall when said shank is inserted into said clamping bore with said contact portion seated against said insulative portion and (ii) said lamp contact is secured in said bore clamping bore solely by friction between said shank and said bore wall, said shank and bore being free of any snap-type engagements.

5. An electric lamp according to claim 4, characterized in that said conductive lead extends into said clamping bore with the end of said lead extending in the direction of insertion of said shank into said clamping bore.

6. An electric lamp according to claim 5, characterized in that said insulative portion comprises a guide bore extending adjacent said clamping bore, said lead extending from said lamp envelope through said guide bore in the direction opposite the direction of insertion of said shank and then into said clamping bore receiving said shank.

7. An electric lamp according to claim 6, wherein said guide bore includes tapered guide walls narrowing in the direction away from said lamp envelope for guiding said lead into said guide bore.

8. An electric lamp according to claim 7, wherein said guide bore terminates adjacent said clamping bore such that said guide bore and said lead extending therefrom into said clamping bore are fully covered by said contact portion of said lamp cap contact.

9. An electric lamp cap according to claim 8, wherein said plastic skirt portion includes a counter bore having a shape complimentary to said contact portion and into which said contact portion is recessed.

10. An electric lamp according to claim 6, wherein said guide bore terminates adjacent said clamping bore such that said guide bore and said lead extending therefrom into said clamping bore are fully covered by said contact portion of said lamp cap contact.

11. An electric lamp according to claim 10, wherein said plastic skirt portion includes a counter bore having a shape complimentary to said contact portion and into which said contact portion is recessed.

12. An electric lamp according to claim 6, wherein said guide bore communicates with said clamping bore.

13. An electric lamp according to claim 12, wherein said plastic skirt portion includes a counter bore having a shape complimentary to said contact portion and into which said contact portion is recessed.

14. An electric lamp cap according to claim 5, wherein said plastic skirt portion includes a counter bore having a shape complimentary to said contact portion and into which said contact portion is recessed.

15. An electric lamp according to claim 4, wherein said plastic skirt portion includes a counter bore having a shape complimentary to said contact portion and into which said contact portion is recessed.

16. An electric lamp according to claim 6, further comprising an additional conductive lead extending from said light source and including a portion clamped between said insulative portion and said threaded shell portion.

17. An electric lamp according to claim 6, wherein said portion clamped between said insulative portion and said shell portion is a free end portion of said lead extending in the direction of insertion of said shank.

18. An electric lamp according to claim 1, further including a conductive lead connected to said light source and wherein said lamp contacts further comprise a center contact including (i) a contact portion for contacting a corresponding contact in a socket and (ii) a rigid shank extending from said contact portion; and said plastic skirt portion has a bore wall defining a clamping bore for receiving said shank, said bore being sized and said plastic portion surrounding said clamping bore having an elasticity selected such that (i) said first conductive lead is securely clamped between said shank and said bore wall when said shank is inserted into said clamping bore with said contact portion seated against said insulative portion and (ii) said lamp contact is secured in said bore clamping bore solely by friction between said shank and said bore wall, said shank and bore being free of any snap-type engagements.

19. An electric lamp according to claim 18, characterized in that said conductive lead extends into said clamping bore with the end of said lead extending in the direction of insertion of said shank into said clamping bore.

20. An electric lamp according to claim 19, characterized in that said insulative portion comprises a guide bore extending adjacent said clamping bore, said lead extending from said lamp envelope through said guide bore in the direction opposite the direction of insertion of said shank and then into said clamping bore receiving said shank.

21. An electric lamp according to claim 20, wherein said guide bore includes tapered guide walls narrowing in the direction away from said lamp envelope for guiding said lead into said guide bore.

22. An electric lamp according to claim 18, wherein said guide bore terminates adjacent said clamping bore such that said guide bore and said lead extending therefrom into said clamping bore are fully covered by said contact portion of said lamp cap contact.

23. An electric lamp cap according to claim 18, wherein said plastic skirt portion includes a counter bore having a shape complimentary to said contact portion and into which said contact portion is recessed.

24. An electric lamp according to claim 1, further comprising a conductive shell portion defining a second lamp cap contact and being fixed on said plastic skirt portion, and said lamp including an additional conductive lead extending from said light source and including a portion clamped between said insulative portion and said shell portion.

25. A reflector lamp, comprising:

a. a lamp envelope, said envelope defining a lamp axis and including a pressed glass reflector body including a basal portion and a reflective surface extending from said basal portion;

b. a light source within said lamp envelope which is energizable for emitting light;

c. first and second conductive leads extending from the light source through the basal portion of the lamp envelope; and d. a skirted lamp base on said basal portion of said lamp envelope, said skirted lamp base including (i) a metal skirt portion having a first circumferential end portion receiving said basal portion of said lamp envelope and a second circumferential end portion, said second circumferential end portion comprising a flanged rim extending transverse to said lamp axis, (ii) a plastic skirt portion of synthetic resin material, said plastic skirt portion having a first circumferential end portion integrally molded to said [second end portion] flanged rim of said metal skirt portion, said plastic skirt portion further including a second end portion having an outer wall terminating at a distal end of said skirt and including an axially extending bore wall;

(iii) a first lamp cap contact comprising (i) a contact portion for contacting a corresponding contact in a socket and (ii) a rigid shank extending from said contact portion;

said bore wall defining a clamping bore for receiving said shank, said clamping bore being sized and said plastic skirt portion surrounding said clamping bore having an elasticity selected such that (i) said first electric lead is securely clamped between said shank and said bore wall when said shank is inserted into said clamping bore with said contact portion seated against said insulative portion and (ii) said lamp contact is secured in said bore clamping bore solely by friction between said shank and said bore wall, said shank and bore being free of any snap-type engagements; and (iv) a second lamp contact comprising a threaded metallic shell secured on said outer wall of said second end portion of said plastic skirt portion, said second conductive lead being clamped between said threaded shell and said outer wall, and said first and second conductive leads being electrically connected to said first and second contacts by said clamping.

26. A lamp according to claim 25, wherein said connections between said first and second leads and said first and second contacts are free of solder joints.

27. A electric lamp according to claim 25, characterized in that said conductive lead extends into said clamping bore with the end of said lead extending in the direction of insertion of said shank into said clamping bore.

28. An electric lamp according to claim 25, wherein said guide bore terminates adjacent said clamping bore such that said guide bore and said lead extending therefrom into said clamping bore are fully covered by said contact portion of said lamp czlp contact.

29. An electric lamp cap according to claim 25, wherein said plastic skirt portion includes a counter bore having a shape complimentary to said contact portion and into which said contact portion is recessed.

30. An electric lamp according to claim 25, wherein said metal skirt portion is mechanically secured to said basal portion and is free of cement.

31. A lamp according to claim 25, wherein said flanged rim has a series of holes through which said plastic skirt portion extends.

* * * * *